US009874045B2

(12) United States Patent
Buchanan

(10) Patent No.: US 9,874,045 B2
(45) Date of Patent: Jan. 23, 2018

(54) DOOR LOCKING SYSTEM

(71) Applicant: Larry Buchanan, Pomona, CA (US)

(72) Inventor: Larry Buchanan, Pomona, CA (US)

( * ) Notice: Subject to any disclaimer, the term of this patent is extended or adjusted under 35 U.S.C. 154(b) by 495 days.

(21) Appl. No.: 14/560,105

(22) Filed: Dec. 4, 2014

(65) Prior Publication Data

US 2016/0160534 A1 Jun. 9, 2016

(51) Int. Cl.

| | |
|---|---|
| ***E05C 1/06*** | (2006.01) |
| ***E05B 65/00*** | (2006.01) |
| ***E05D 15/16*** | (2006.01) |
| ***E05F 15/668*** | (2015.01) |
| ***E05B 61/00*** | (2006.01) |
| *E05C 3/06* | (2006.01) |

(52) U.S. Cl.

CPC ..... *E05B 65/0021* (2013.01); *E05B 61/00* (2013.01); *E05D 15/165* (2013.01); *E05F 15/668* (2015.01); *E05Y 2201/22* (2013.01); *E05Y 2201/43* (2013.01); *E05Y 2800/73* (2013.01); *Y10S 292/36* (2013.01); *Y10T 292/1021* (2015.04)

(58) Field of Classification Search

CPC ..... Y10S 292/36; Y10T 292/1021
USPC ..... 292/144; 160/201
See application file for complete search history.

(56) References Cited

U.S. PATENT DOCUMENTS 1,972,695 A * 9/1934 Staude ..... E05F 15/41 160/193
3,096,815 A * 7/1963 May ..... E05B 47/0002 160/188
3,890,608 A * 6/1975 Peterson ..... E05B 45/06 200/61.64
3,933,382 A * 1/1976 Counts ..... E05B 47/0012 160/201
4,080,757 A * 3/1978 Westerman ..... E05B 65/0021 292/166
4,169,616 A * 10/1979 Peterson ..... E05B 51/02 137/106
4,254,582 A 3/1981 McGee
4,659,121 A 4/1987 McGee
4,784,415 A * 11/1988 Malaval ..... E05B 47/00 292/144
4,799,719 A * 1/1989 Wood ..... E05B 47/0012 292/144
4,917,419 A 4/1990 Morn, Jr. et al.
5,371,970 A * 12/1994 Ganikon ..... E05B 65/0021 160/189
5,489,130 A * 2/1996 Clark ..... E05B 65/0021 292/66
5,533,561 A 7/1996 Forehand, IV
6,382,005 B1 5/2002 White et al.
(Continued)

FOREIGN PATENT DOCUMENTS

WO WO2006062584 6/2006

*Primary Examiner* — Carlos Lugo

(57) ABSTRACT

A door locking system includes a door movably mounted on a rail. The door includes rollers rollably coupling the door to the rail. An opener is coupled to the door. The opener positions the door in an open position and a closed position. A lock is coupled to the rail. The lock is in communication with the opener. The lock is automatically positioned in a locked position after the opener positions the door in a closed position. Thus, the door is retained in the closed position.

8 Claims, 5 Drawing Sheets

(56) References Cited

U.S. PATENT DOCUMENTS

| | | | | |
|---|---|---|---|---|
| 6,485,068 | B1 * | 11/2002 | Sauve | E05D 13/003 160/191 |
| 7,114,753 | B2 * | 10/2006 | Nodorft | E05B 47/0002 160/201 |
| 7,240,524 | B1 | 7/2007 | White et al. | |
| 7,523,971 | B2 * | 4/2009 | Ebert | E05B 3/04 292/347 |
| 7,604,266 | B2 * | 10/2009 | Ellis | E05B 3/00 292/336.3 |
| 8,596,330 | B2 * | 12/2013 | Slusarski | E05B 47/0696 160/271 |
| 8,833,118 | B1 * | 9/2014 | McLane | E05C 1/08 248/229.15 |
| 9,187,931 | B2 * | 11/2015 | Hudson | E05B 65/0021 |

* cited by examiner

DOOR LOCKING SYSTEM

BACKGROUND OF THE DISCLOSURE

Field of the Disclosure

The disclosure relates to locking devices and more particularly pertains to a new locking device for automatically locking a garage door in a closed position.

SUMMARY OF THE DISCLOSURE

An embodiment of the disclosure meets the needs presented above by generally comprising a door movably mounted on a rail. The door includes rollers rollably coupling the door to the rail. An opener is coupled to the door. The opener positions the door in an open position and a closed position. A lock is coupled to the rail. The lock is in communication with the opener. The lock is automatically positioned in a locked position after the opener positions the door in a closed position. Thus, the door is retained in the closed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
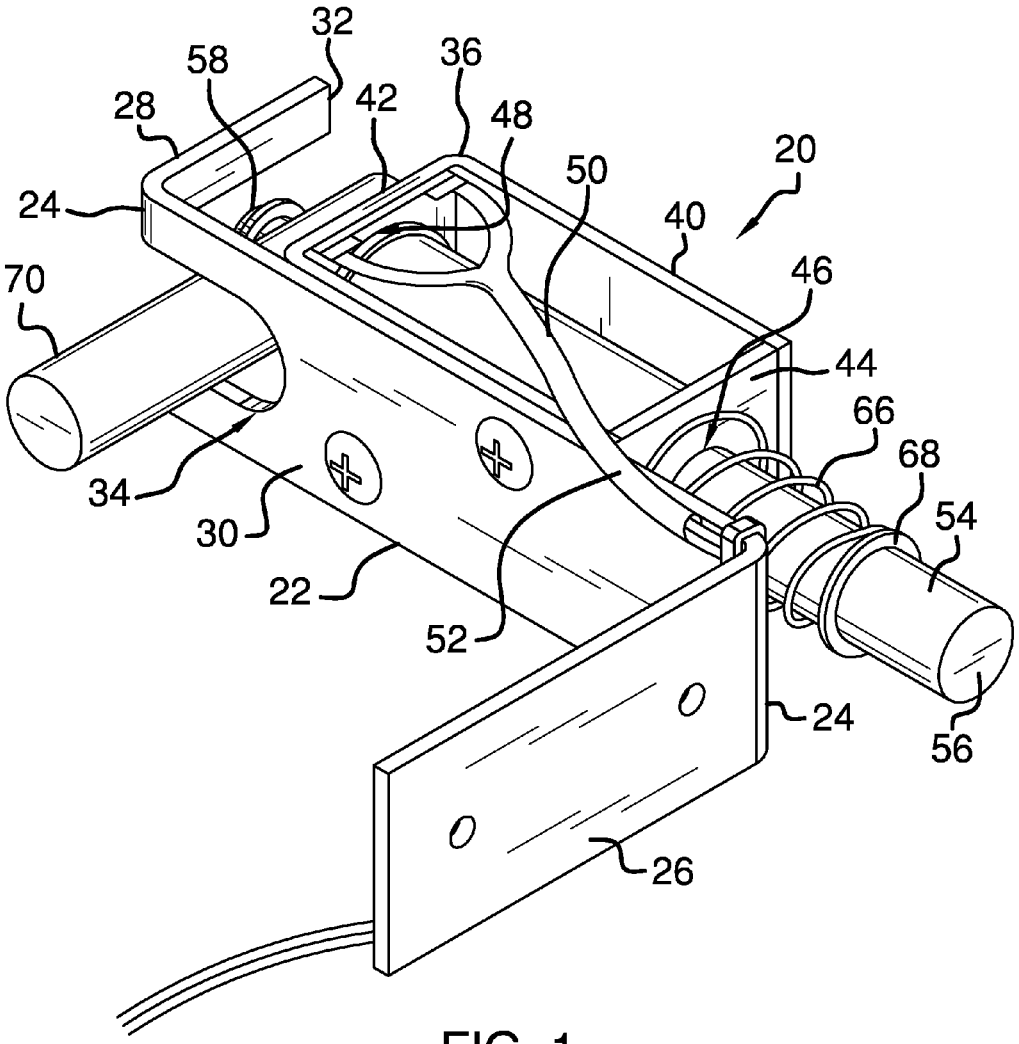
FIG. 1 is a perspective view of a door locking system according to an embodiment of the disclosure.
Figure 2:
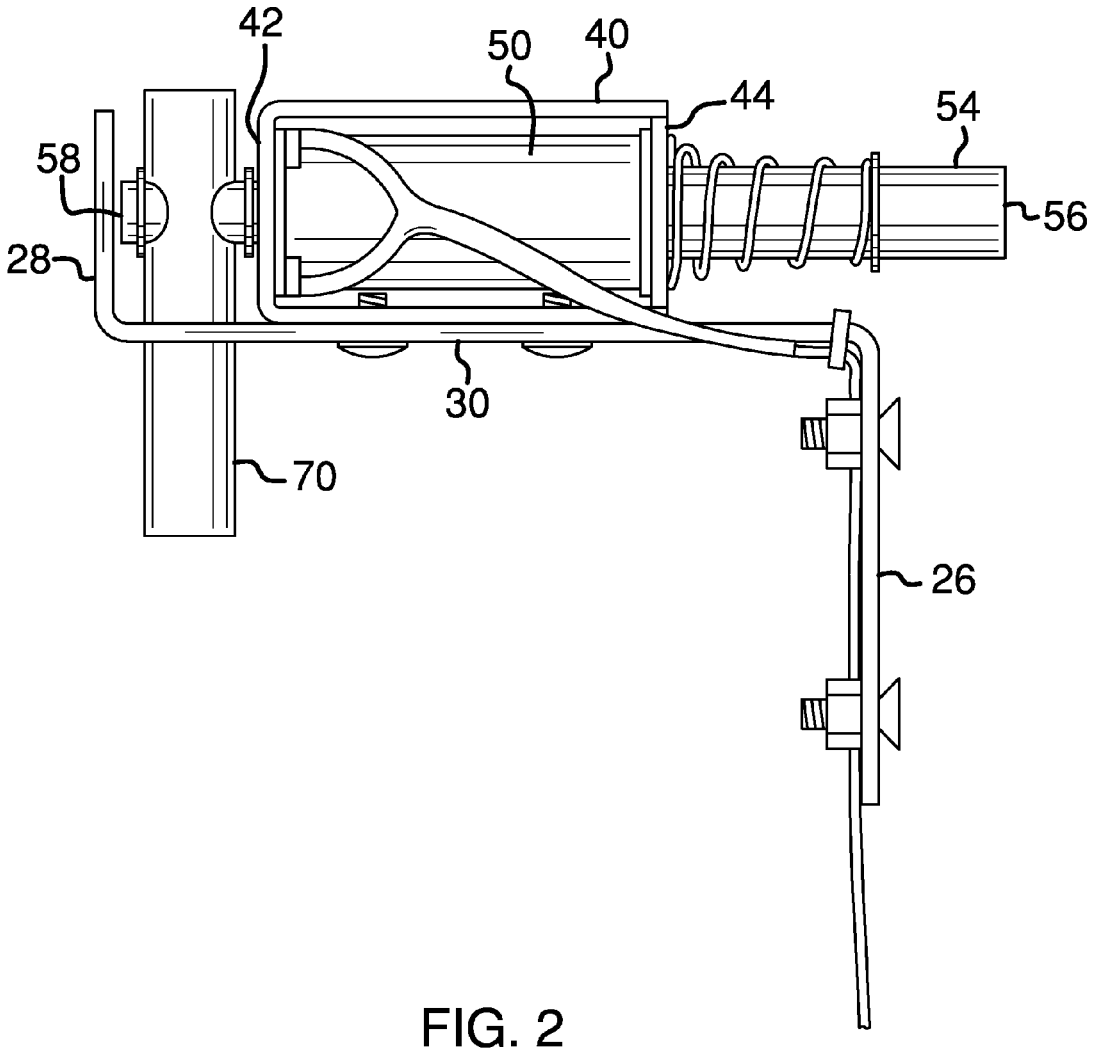
FIG. 2 is a right side view of an embodiment of the disclosure.
Figure 3:
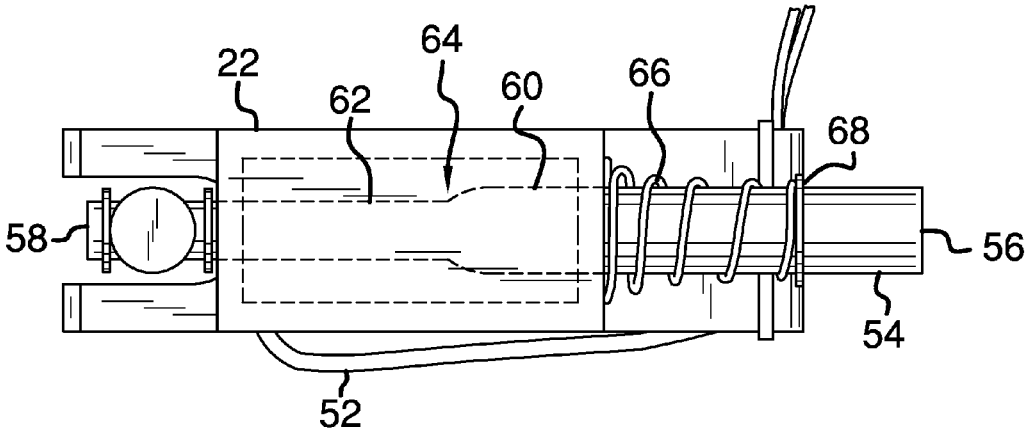
FIG. 3 is a top view of an embodiment of the disclosure.
Figure 4:
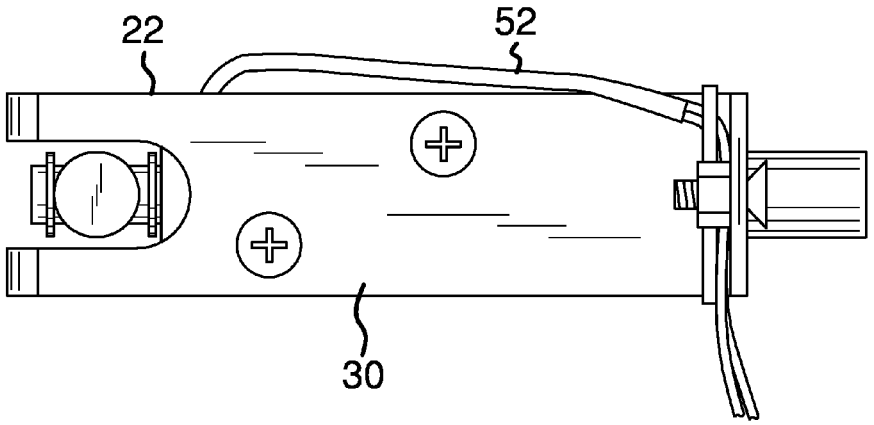
FIG. 4 is a bottom view of an embodiment of the disclosure.
Figure 5:
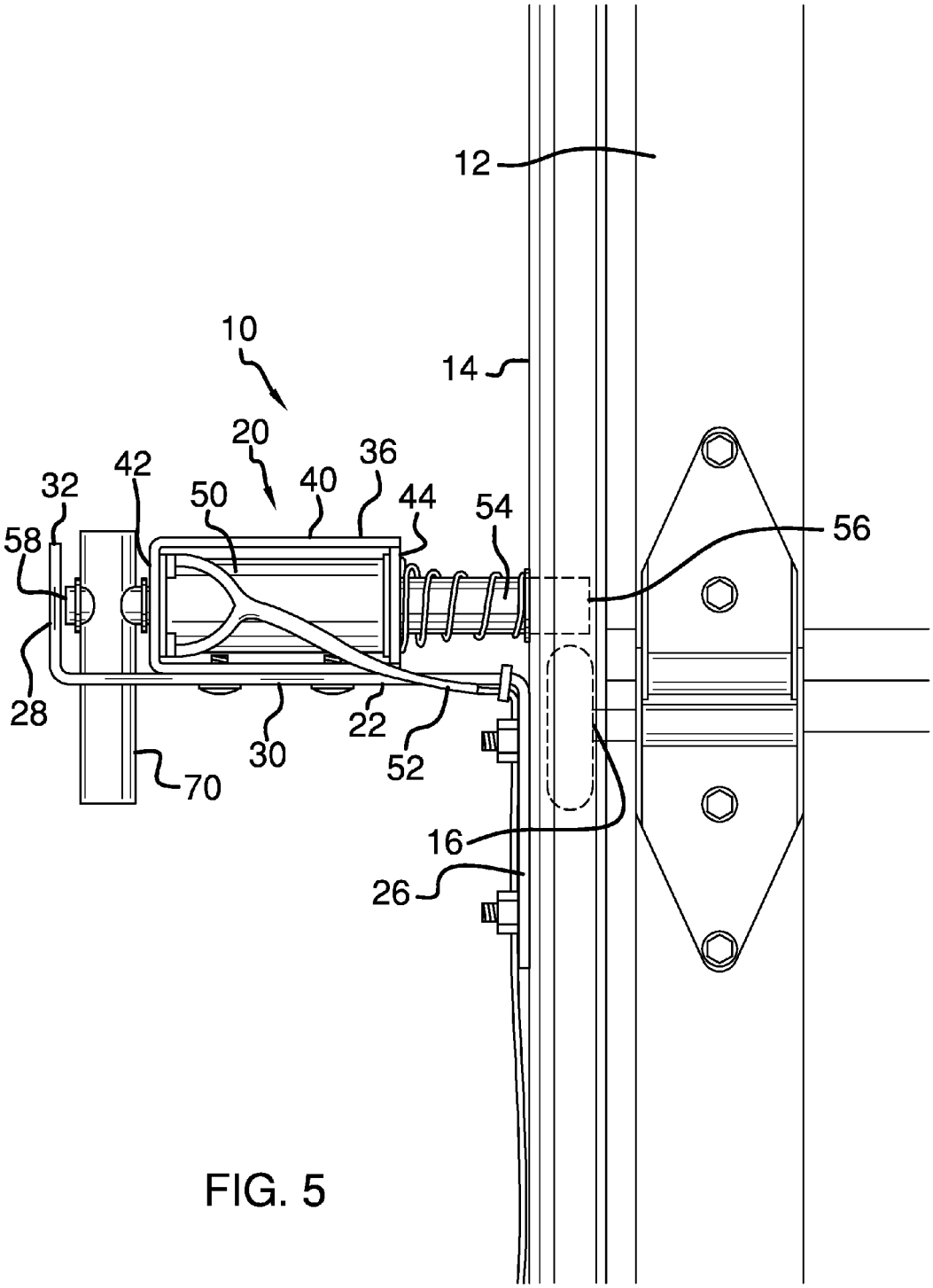
FIG. 5 is a in-use view of an embodiment of the disclosure.
Figure 6:
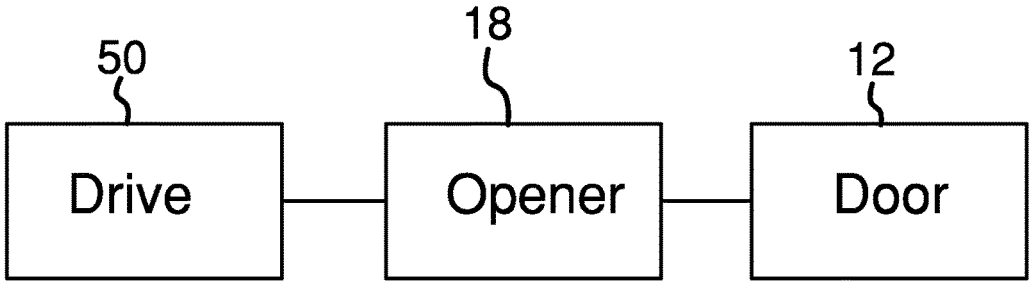
FIG. 6 is a schematic view of an embodiment of the disclosure.

With reference now to the drawings, and in particular to FIGS. 1 through 6 thereof, a new locking device embodying the principles and concepts of an embodiment of the disclosure and generally designated by the reference numeral 10 will be described.

As best illustrated in FIGS. 1 through 6, the door locking system 10 generally comprises a door 12 movably mounted on a rail 14. The door 12 includes rollers 16 rollably coupling the door 12 to the rail 14. The door 12 may be a garage door of any conventional design.

An opener 18 is coupled to the door 12. The opener 18 positions the door 12 in an open position and a closed position. The opener 18 may be an automatic garage door opener of any conventional design. Additionally, the opener 18 detects when the door 12 has been moved into the closed position and the open position.

A lock 20 is coupled to the rail 14. The lock 20 is in communication with the opener 18. The lock 20 is automatically positioned in a locked position after the opener 18 positions the door 12 in a closed position. Thus, the door 12 is retained in the closed position. The lock 20 prevents the door 12 from being forced open.

The lock 20 comprises a bracket 22 that has a pair of bends 24 thereon to define a first section 26 and a second section 28. The first 26 and second sections 28 each form an angle with respect to a central section 30. The first section 26 and the second section 28 extend in opposite directions from the central section 30.

The bracket 22 is coupled to the rail 14 such that the first section 26 abuts the rail 14. The central section 30 extends laterally away from the rail 14. The second section 28 has a first end 32. The bracket 22 has a groove 34 extending inwardly from the first end 32 and continuing onto the central section 30.

A housing 36 has a bottom wall 38 and a perimeter wall 40 extending upwardly therefrom. The perimeter wall 40 has a back side 42 and a front side 44. The housing 36 is coupled to the central section 30 such that the front side 44 is positioned between the rail 14 and the back side 42. The front side 44 has a first aperture 46 extending therethrough. The back side 42 has a second aperture 48 extending therethrough.

A drive 50 is positioned within the housing 36. The drive 50 is electrically coupled to the opener 18. The drive 50 may be an electrical solenoid or the like. A conductor 52 is electrically coupled between the drive 50 and the opener 18.

A rod 54 has a first end 56 and a second end 58. The rod 54 extends through the drive 50 such that the first end 56 is directed through the first aperture 46 and the second end 58 is directed through the second aperture 48. The rod 54 is mechanically coupled to the drive 50.

The rod 54 has a first section 60 and a second section 62. The first section 60 extends from the first end 56 to a middle 64 of the rod 54. The second section 62 extends from the middle 64 of the rod 54 to the second end 58 of the rod 54. The first section 60 may have a diameter between 10 mm and 15 mm. The second section 62 may have a diameter between 7 mm and 10 mm. The rod 54 may have a length between 12 cm and 18 cm.

The drive 50 urges the rod 54 to extend through the rail 14 when the opener 18 detects the closed position of the door 12. The rollers 16 abut the rod 54 such that the door 12 is prevented from is moved from the closed position. The drive 50 urges the rod 54 away from the rail 14 when the opener 18 receives a signal to open the door 12. Thus, the door 12 is allowed to be positioned in the open position.

A spring biasing member 66 is positioned around the rod 54 between the first end 56 and the front side 44 of the housing 36. A clip 68 is non-movably coupled to the rod 54 between the spring biasing member 66 and the first end 56. The spring biasing member 66 biases the first end 56 of the rod 54 away from the front side 44.

A handle 70 is coupled to the rod 54. The handle 70 is positioned proximate the second end 58 and is oriented transverse to the rod 54. The handle 70 is positioned within the groove 34 in the central section 30. Moreover, the handle 70 is manually urgeable away from the back side 42 of the housing 36 such that the rod 54 is positioned in the unlocked position.

In use, the opener 18 positions the door 12 in the closed position. The rod 54 engages the rail after the door 12 has fully closed. The handle 70 is used to unlock the door 12 if the opener 18 or the drive 50 experiences a mechanical failure. The door 12 may be manually moved into the open position after the handle 70 is used to unlock the door 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A door locking system configured to lock a garage door, said assembly comprising:

a door movably mounted on a rail, said door including rollers rollably coupling said door to said rail;

an opener coupled to said door, said opener positioning said door in an open position and a closed position; and a lock coupled to said rail, said lock being in communication with said opener, said lock being automatically positioned in a locked position after said opener positions said door in a closed position such that said door is retained in said closed position, said lock comprising a bracket having a pair of bends thereon to define a first section and a second section each forming an angle with respect to a central section, said first section and said second section extending in opposite directions from said central section, said second section having a distal end relative to said central section, a housing coupled to said bracket, a drive positioned within said housing, said drive being electrically coupled to said opener, a rod having a first end and a second end, said rod extending through said drive, said rod being mechanically coupled to said drive, said drive urging said rod to extend through said rail when said opener detects said closed position of said door, said rollers abutting said rod such that said door is prevented from being moved from said closed position, a handle coupled to said rod, said handle being positioned proximate said second end of said rod, and a groove in said bracket, said groove extending inwardly through said second section of said bracket and continuing onto said central section, said handle being positioned within said groove in said central section when said rod is extended through said rail wherein said handle is configured to be grasped to be manually urgeable away from said rail and through said groove through said second section such that said rod is positioned in said unlocked position.

2. The assembly according to claim 1, wherein said bracket being coupled to said rail such that said first section abuts said rail and said central section extends laterally away from said rail.

3. The assembly according to claim 1, further comprising said housing having a bottom wall and a perimeter wall extending upwardly therefrom, said perimeter wall having a back side and a front side, said front side having a first aperture extending therethrough, said back side having a second aperture extending therethrough, said rod extending through said first aperture and said second aperture.

4. The assembly according to claim 3, wherein said housing being coupled to said central section such that said front side is positioned between said rail and said back side.

5. The assembly according to claim 1, wherein said drive urging said rod away from said rail thereby allowing said door to be positioned in said open position when said opener receives a signal to open said door.

6. The assembly according to claim 5, wherein a spring biasing member positioned around said rod between said first end and said front side of said housing.

7. The assembly according to claim 6, wherein a clip non-movably coupled to said rod between said spring biasing member and said first end, said spring biasing member biasing said first end of said rod away from said front side.

8. A door locking system configured to lock a garage door, said assembly comprising:

a door movably mounted on a rail, said door including rollers rollably coupling said door to said rail;

an opener coupled to said door, said opener positioning said door in an open position and a closed position;

a lock coupled to said rail, said lock being in communication with said opener, said lock being automatically positioned in a locked position after said opener positions said door in a closed position such that said door is retained in said closed position, said lock comprising a bracket having a pair of bends thereon to define a first section and a second section each forming an angle with respect to a central section, said first section and said second section extending in opposite directions from said central section, said bracket being coupled to said rail such that said first section abuts said rail and said central section extends laterally away from said rail, said second section having a end distal end relative to said central section, a housing having a bottom wall and a perimeter wall extending upwardly therefrom, said perimeter wall having a back side and a front side, said housing being coupled to said central section such that said front side is positioned between said rail and said back side, said front side having a first aperture extending therethrough, said back side having a second aperture extending therethrough, a drive positioned within said housing, said drive being electrically coupled to said opener, a rod having a first end and a second end, said rod extending through said drive such that said first end is directed through said first aperture and said second end is directed through said second aperture, said rod being mechanically coupled to said drive, said drive urging said rod to extend through said rail when said opener detects said closed position of said door, said rollers abutting said rod such that said door is prevented from being moved from said closed position, said drive urging said rod away from said rail thereby allowing said door to be positioned in said open position when said opener receives a signal to open said door, a spring biasing member positioned around said rod between said first end and said front side of said housing, a clip non-movably coupled to said rod between said spring biasing member and said first end, said spring biasing member biasing said first end of said rod away from said front side, a handle coupled to said rod, said handle being positioned proximate said second end of said rod, and a groove in said bracket, said groove extending inwardly through said second section of said bracket and continuing onto said central section, said handle being positioned within said groove in said central section when said rod is extended through said rail wherein said handle is configured to be grasped to be manually urgeable away from said rail and through said groove through said second section such that said rod is positioned in said unlocked position.

* * * * *